US006652428B2

(12) United States Patent
Meller et al.

(10) Patent No.: US 6,652,428 B2
(45) Date of Patent: Nov. 25, 2003

(54) TRAINING DEVICE FOR HAND-WRESTLING

(75) Inventors: Arie Meller, Cologne (DE); Moshe Abraham, Ephraim (IL); Zeev Stahl, Jerusalem (IL); Binyamin Fredkin, Alon Shvut (IL)

(73) Assignee: Shilo Technologies Ltd., Jerusalem (IL)

( * ) Notice: Subject to any disclaimer, the term of this patent is extended or adjusted under 35 U.S.C. 154(b) by 0 days.

(21) Appl. No.: 10/032,768

(22) Filed: Dec. 27, 2001

(65) Prior Publication Data

US 2002/0107120 A1 Aug. 8, 2002

(30) Foreign Application Priority Data

Dec. 28, 2000 (IL) ..... 140612

(51) Int. Cl.[7] ..... A63B 21/02
(52) U.S. Cl. ..... 482/122
(58) Field of Search ..... D21/677; 482/137, 482/905, 112, 123, 129, 111, 113, 44

(56) References Cited

U.S. PATENT DOCUMENTS 911,925 A * 2/1909 Zeno
4,129,297 A * 12/1978 Dolan
4,603,857 A * 8/1986 Chipman et al.
5,087,038 A * 2/1992 Hao

* cited by examiner

*Primary Examiner*—Jerome W. Donnelly
(74) *Attorney, Agent, or Firm*—Bryan Cave LLP

(57) ABSTRACT

The invention provides a hand-wrestling training device, comprising an elongated main base carrying at one of its ends a mounting means to which one end of a spring means is hingedly articulated; at least one mounting plate fixedly attached to the main base near the other end of the base; a head unit pivotably mounted in the mounting plate; a pusher arm fixedly attached at one of its ends to the head unit and provided with a plate element at the other one of its ends; a body movable in translation along the pusher arm, the second end of the spring means being articulated to the body; adjustment means for altering the mechanical advantage afforded to the user by moving the body along the pusher arm, thereby altering the effective length of the pusher arm, and a gripping handle hingedly attached to a portion of the head unit; the gripping handle, when turned downward, causing the pusher arm to be applied against the opposing force of the spring.

12 Claims, 8 Drawing Sheets

TRAINING DEVICE FOR HAND-WRESTLING

FIELD OF THE INVENTION

The present invention relates to a training device for hand-wrestling.

BACKGROUND OF THE INVENTION

Hand-wrestling, once mainly practiced in pubs and similar establishments, is becoming increasingly popular and, indeed, professional, with regional and even national competitions being held everywhere.

One problem encountered by a person wanting to engage in this sport is the difficulty in finding a partner for training in his own good time and, if possible, at home.

DISCLOSURE OF THE INVENTION

It is thus one of the objects of the present invention to provide a hand-wrestling trainer in the form of a simple, inexpensive, portable device that can be mounted on any table and allows its user to test his hand-wrestling skill against the steplessly adjustable opposing force of a spring, under conditions that simulate the respective positions of real-life opponents.

According to the invention, the above object is achieved by providing a hand-wrestling training device, comprising an elongated main base carrying at one of its ends a mounting means to which one end of a spring means is hingedly articulated; at least one mounting plate fixedly attached to said main base near the other end of said base; a head unit pivotably mounted in said mounting plate; a pusher arm fixedly attached at one of its ends to said head unit and provided with a plate element at the other one of its ends; a body movable in translation along said pusher arm, the second end of said spring means being articulated to said body; adjustment means for altering the mechanical advantage afforded to the user by moving said body along said pusher arm, thereby altering the effective length of said pusher arm, and a gripping handle hingedly attached to a portion of said head unit; said gripping handle, when turned downward, causing said pusher arm to be applied against the opposing force of said spring.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a perspective view of the hand-wrestling device according to the invention;

FIG. 2 is a perspective view of the device of FIG. 1, seen from another direction;

FIG. 3 is a cross-sectional view along plane III—III of FIG. 1;

FIG. 4 is a perspective view of the sliding block;

FIG. 5 is a cross-sectional view of the device with the sliding block in the upper limit position;

FIG. 6 is a view similar to FIG. 5, but with the sliding block in the lower limit position;

FIG. 7 is a perspective view of a second embodiment of the hand-wrestling device according to the invention;

FIG. 8 is a view of the embodiment of FIG. 7, as seen from another direction;

FIG. 9 is a view of the device of FIG. 7, with the handle in one of its terminal positions;

FIG. 10 is a perspective view, to an enlarged scale, of the cable-drum head unit;

FIG. 11 is a cross-sectional view of the cable-drum head unit with the panel being activated by the user's finger;

Figure 12:
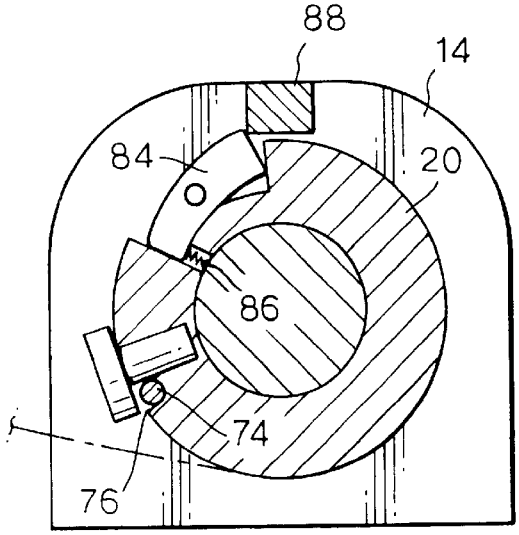
Figure 13:
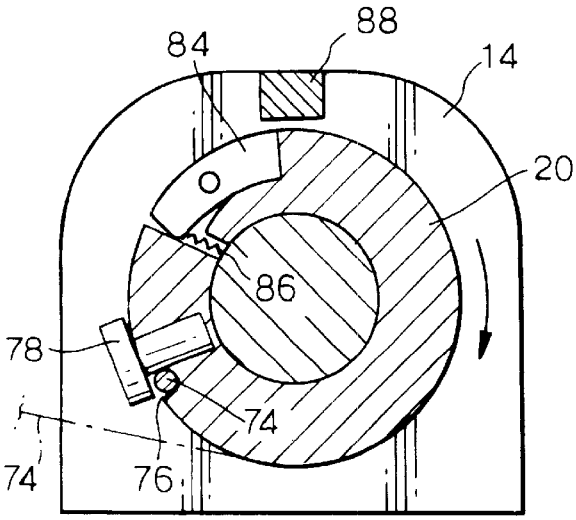

FIG. 12 shows the pawl retained in the activated position by friction, after the user's finger has been withdrawn, and FIG. 13 shows the pawl having snapped back into its recess and no longer preventing rotation of the head unit in the clockwise direction.

DETAILED DESCRIPTION

Figure 1:
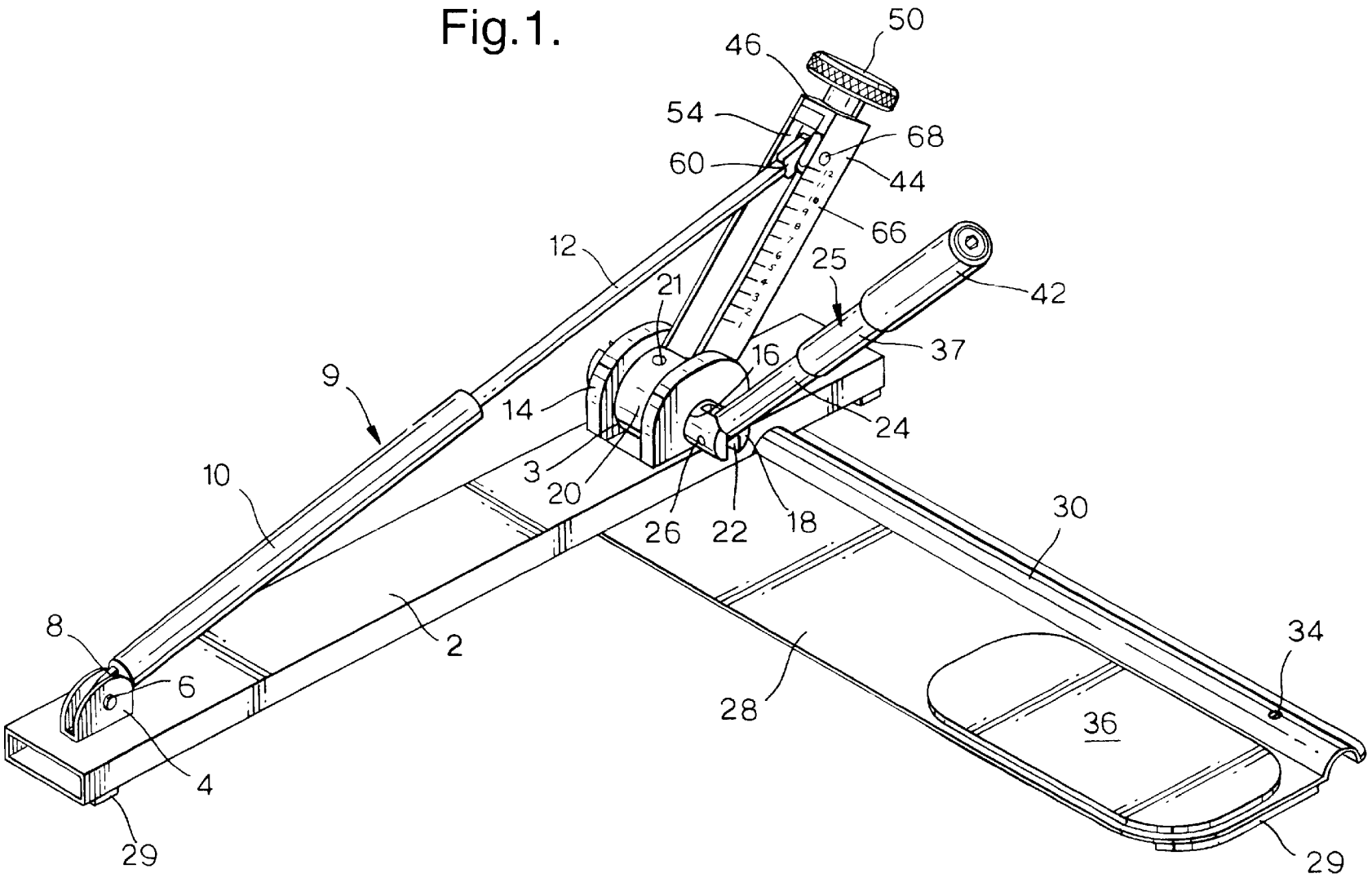

Referring now to the drawings, there is seen in FIG. 1 a device having an elongated main base 2, advantageously made of a rectangular metal profile. Fixedly attached to the left end of base 2, preferably by welding, is a clevis-like mount 4, to which, by means of pin 6, is hingedly articulated the lug-shaped end 8 of a commercially available, so-called gas spring 9, which consists of a cylinder 10 and a plunger 12 and contains a pre-compressed gas.

Two parallel mounting plates 14 are fixedly attached to base 2 close to its other end, at a distance from one another and substantially perpendicular to the base, and extending through a window 3 down to the bottom of the base. Plates 14 are provided with co-axial bores 16. Shaft 18, fixedly connected to a head unit 20 by means of pin 21, is pivotably mounted in bores 16. Shaft 18 projects on both sides beyond mounting plates 14, each projecting portion being provided with a slot 22. A bar 24, constituting the lower portion of a handle 25, can be hingedly articulated into either of slots 22 with the use of a pin 26.

Figure 2:
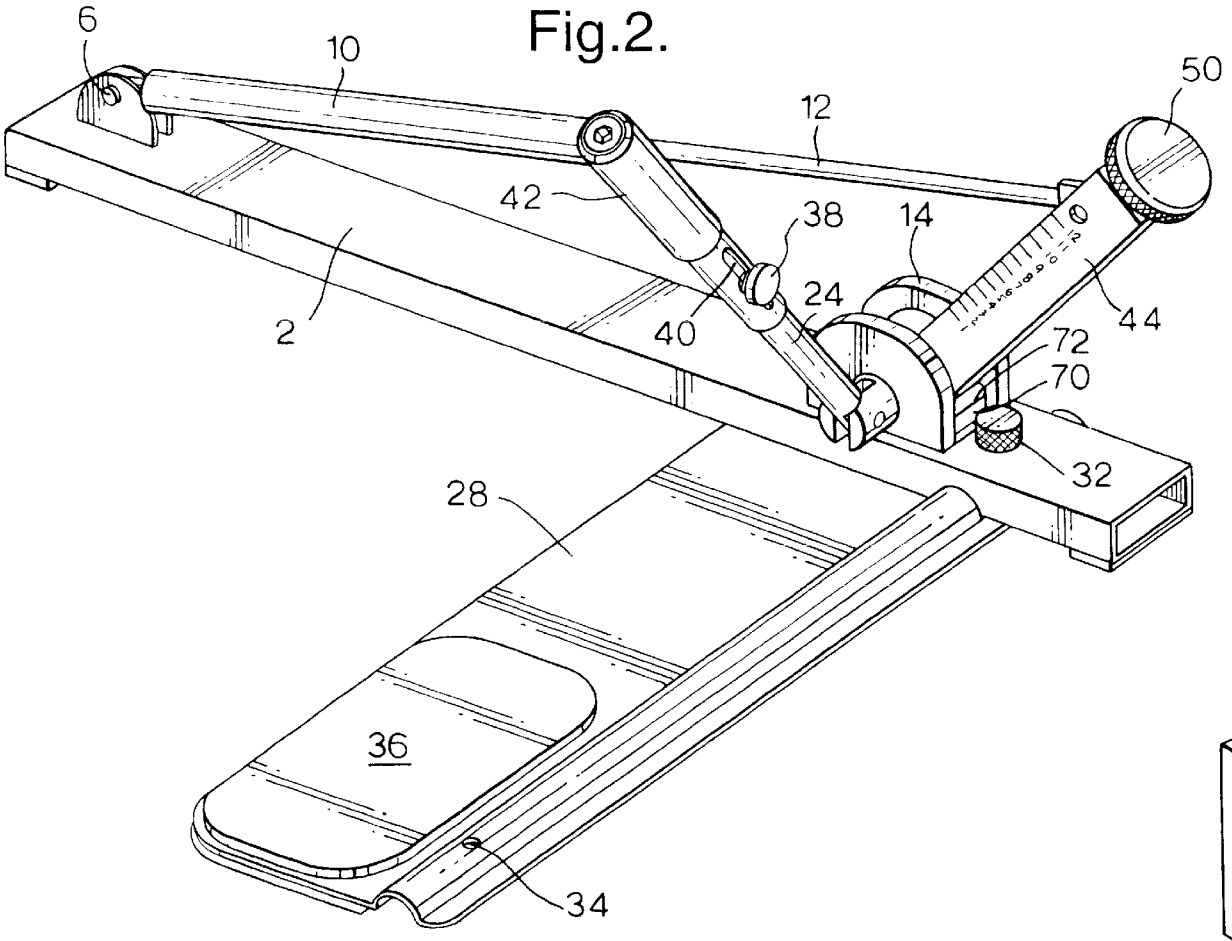

In FIG. 1, the device is shown rigged for a right-handed user. Secondary base 28 is constrained in its perpendicular direction relative to base 2 by a ridge-like rib 30 that fits into a corresponding cut across base 2 and is locked into the selected position by means of thumbscrew 32 (FIG. 2). In order to arrange the device for a left-handed user, thumbscrew 32 is unscrewed, base 28 is slid over to the other side, and thumbscrew 32 is screwed into another threaded hole 34. The elbow-supporting pad 36 rests freely on base 28, and is transferred to the other side when base 28 is slid over. Obviously, handle 25 is also transferred to the other side. Both bases 2 and 28 rest on rubber pads 29 which, when the user presses his elbow against supporting pad 36, prevent the right end of base 2 from being raised during the initial application of force to handle 25 and produce a sufficient amount of friction to obviate any need to clamp the device to the table.

Also shown in FIG. 1 is a tube 37 telescoping over bar 24, the position of which relative to bar 24 can be adjusted with the aid of a thumbscrew 38 (FIG. 2) and an elongated hole 40. The upper half of tube 37 is covered by a rubber sleeve 42, which serves as the gripping position of handle 25. Due to the above-described articulation of bar 24 to shaft 18, handle 25 can move relative to head unit 20 with one degree of freedom in rotation, in a plane containing the axis of pivoting of head unit 20, i.e., of shaft 18.

Figure 3:
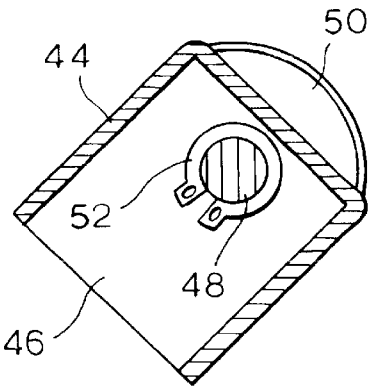

Further seen in FIG. 1 is a pusher arm 44 fixedly attached to, and thus rotating together with, head unit 20. Pusher arm 44 is in the form of a channel profile provided with an end plate 46 (FIG. 3). The threaded shaft 48 of a thumbscrew 50 passes through end plate 46 (seen to better effect in FIG. 5), constrained to one degree of freedom in rotation by a retaining ring 52 (FIG. 3).

Figure 4:
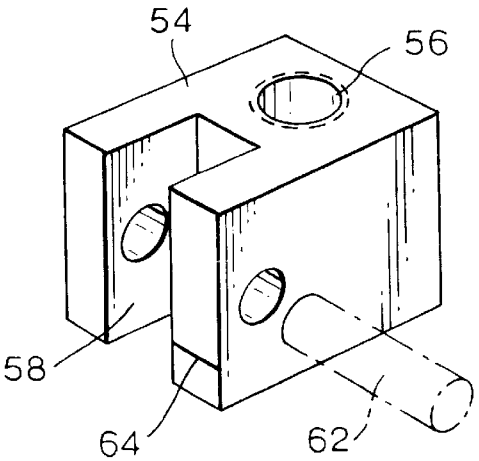

Inside pusher arm 44 there is slidingly accommodated a body or block 54 (shown at an enlarged scale in FIG. 4), provided with an internal thread 56 which engages shaft 48 of thumbscrew 50. Consequently, when thumbscrew 50 is rotated, block 54, constrained by the channel shape of arm 44 to one degree of freedom in translation, will move either up or down arm 44, depending on the sense of rotation.

Also shown is slot 58, in which is seated the lug-shaped end 60 of plunger 12, hingedly articulated to block 54 by means of a pin 62. Further seen is an engraved line 64, constituting the index line for a scale 66 provided on at least one of the wings of the channel profile of arm 44. Scale 66 is arbitrary, serving mainly as a reference for the user. A hole 68 in pusher arm 44 serves for assembly purposes only: it is through this hole that pin 62 is introduced into block 54, to serve as a hinge pin for the lug-shaped end 60 of plunger 12.

An essential component of the device is a mechanical stop that defines the starting position of gripping handle 25, in which the handle must be located in a vertical plane. This stop is in the shape of a blade 70 (seen in FIGS. 2, 5 and 6) rigidly attached to mounting plates 14. The slanting edge 72 of blade 70 is a safety feature, protecting anyone's fingers near blade 70, should the user suddenly let go of the depressed handle 25, causing pushing arm 44 to be flung back.

Figure 5:
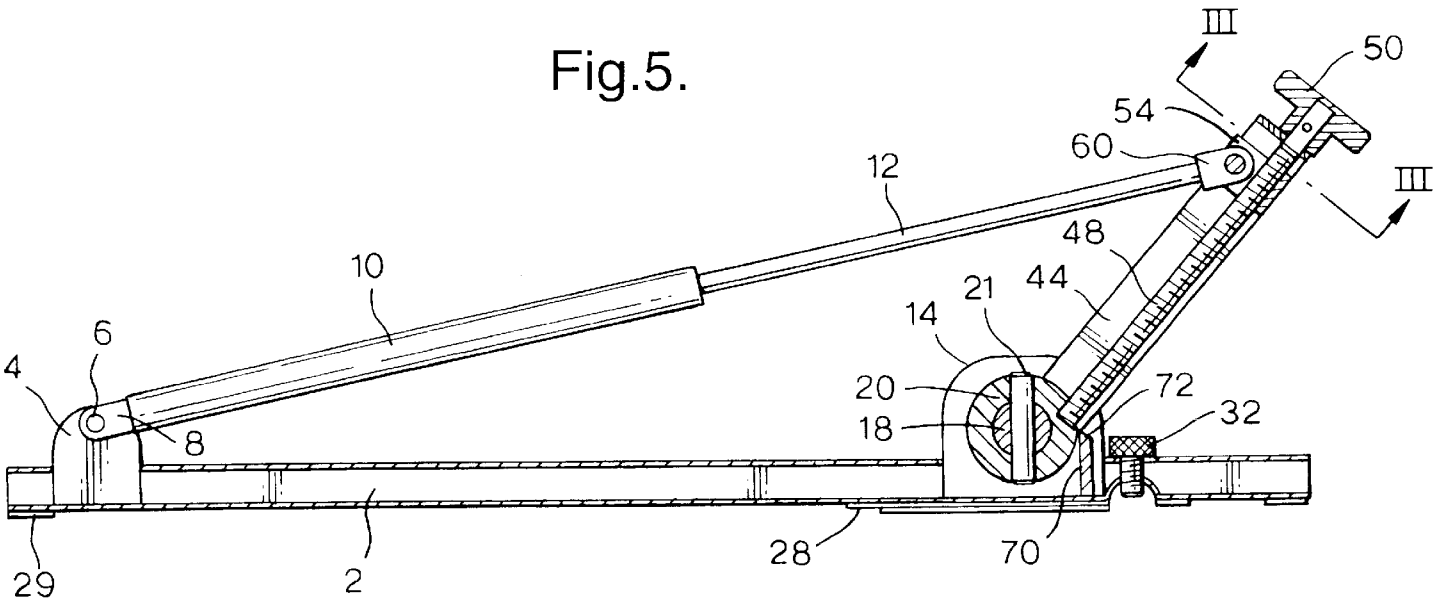
Figure 6:
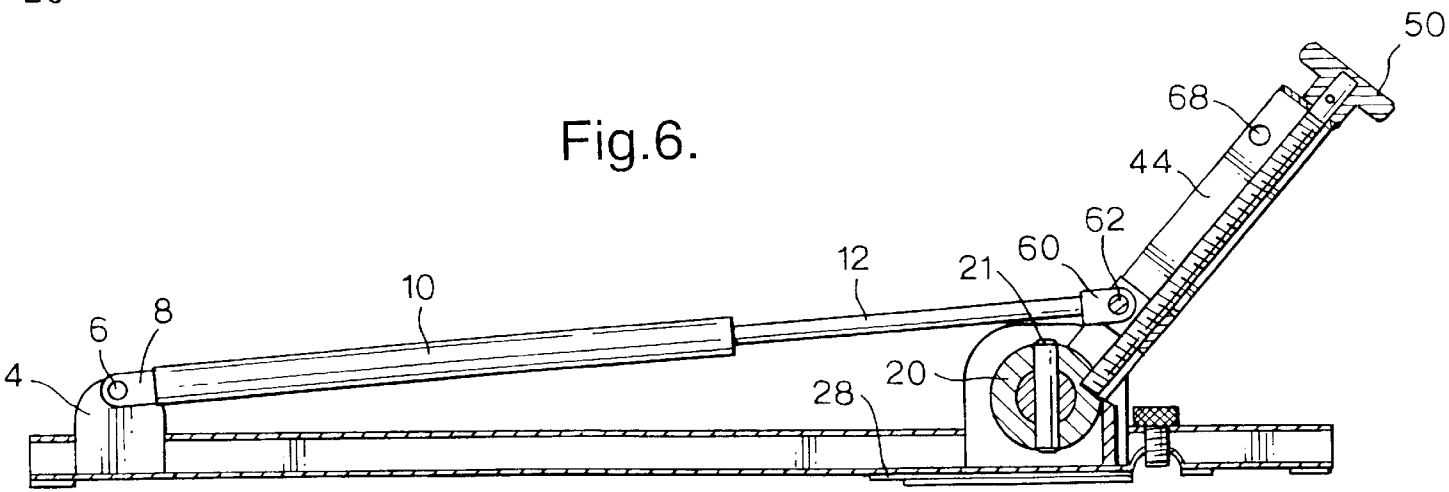

FIGS. 5 and 6 illustrate the two limit positions of block 54. With the block in the position shown in FIG. 5, the user has the smallest mechanical advantage and, consequently, has to apply the greatest force to overcome the counter-force of spring 9. With the block in the position shown in FIG. 6, the user has the largest mechanical advantage and, consequently, can overcome spring 9 by application of a relatively small force.

A second embodiment of the invention comes even closer to a full simulation of the real event, inasmuch as the device is able, in principle, to "beat" the user by forcing his hand down towards the table.

Figure 7:
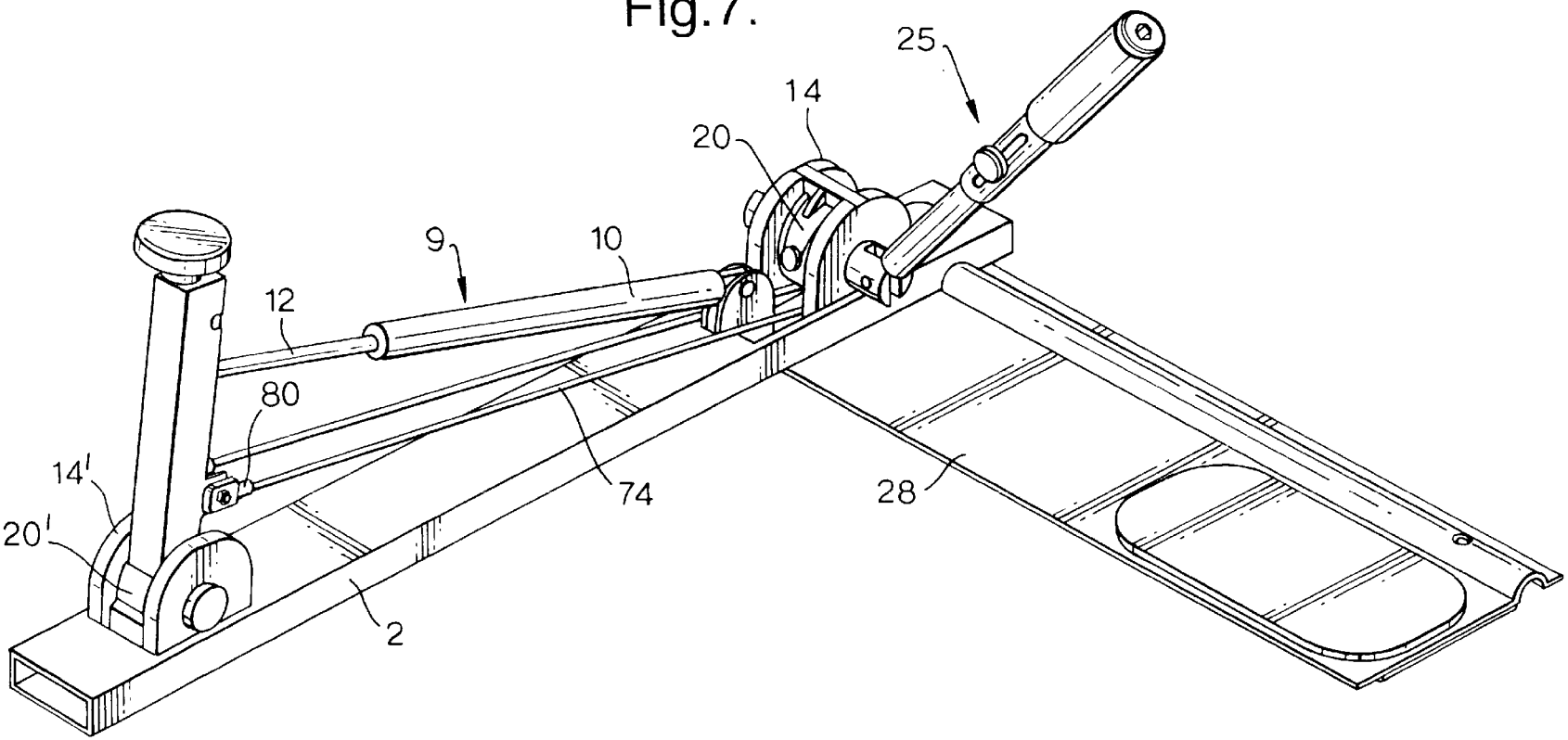
Figure 8:
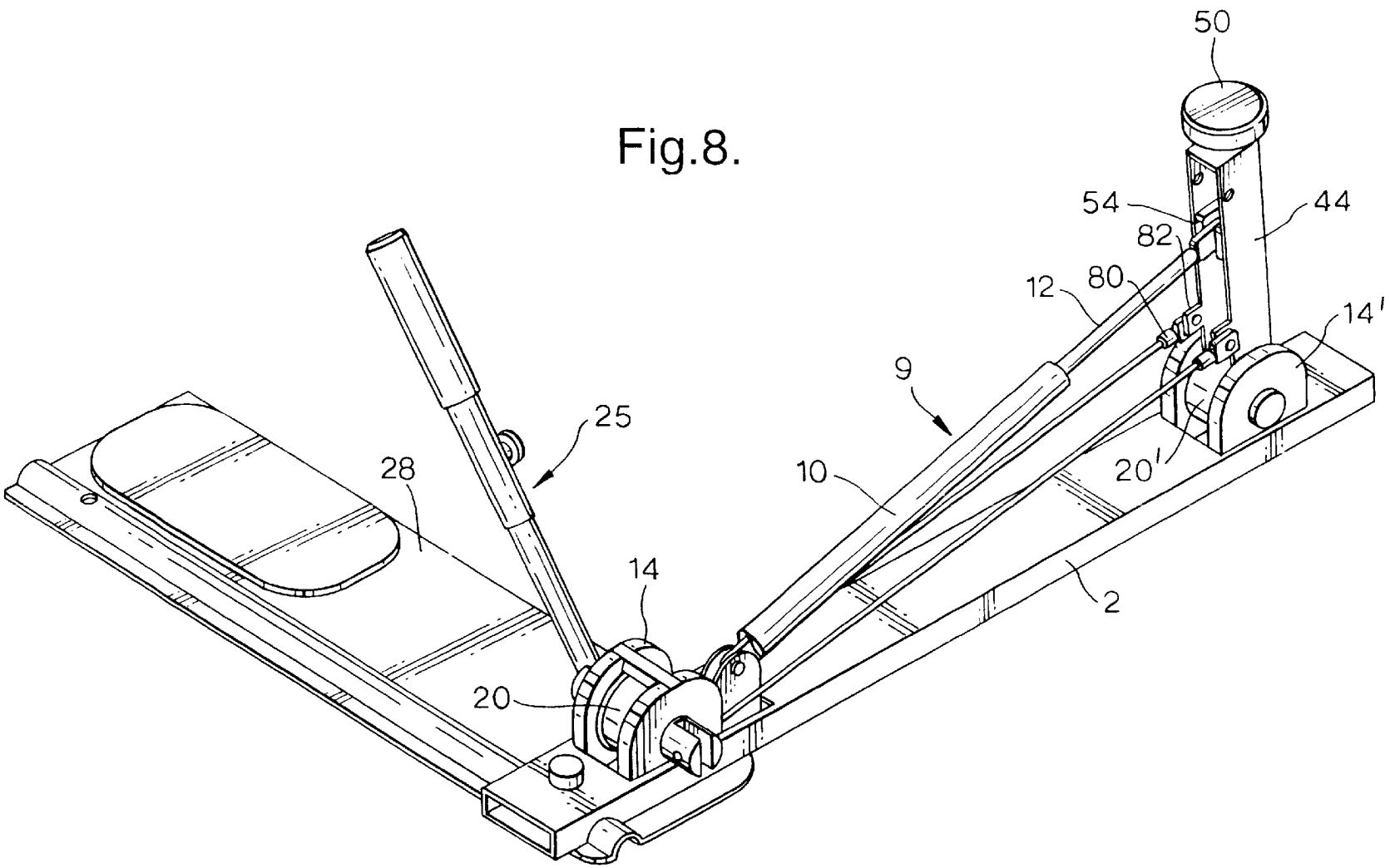

The components of the first and second embodiments are substantially identical, with some exceptions and additions. Seen in FIG. 7 is a similar base 2, to which are attached two pairs of mounting plates 14, 14', extending through window 3 in base 2, each pair having its own head unit 20, 20', respectively. Pusher arm 44 is fixedly attached to head unit 20', with plunger 12 of spring 9 being articulated to block 54 which, as in the first embodiment, is slidingly mounted inside arm 44 (FIG. 8).

Figure 10:
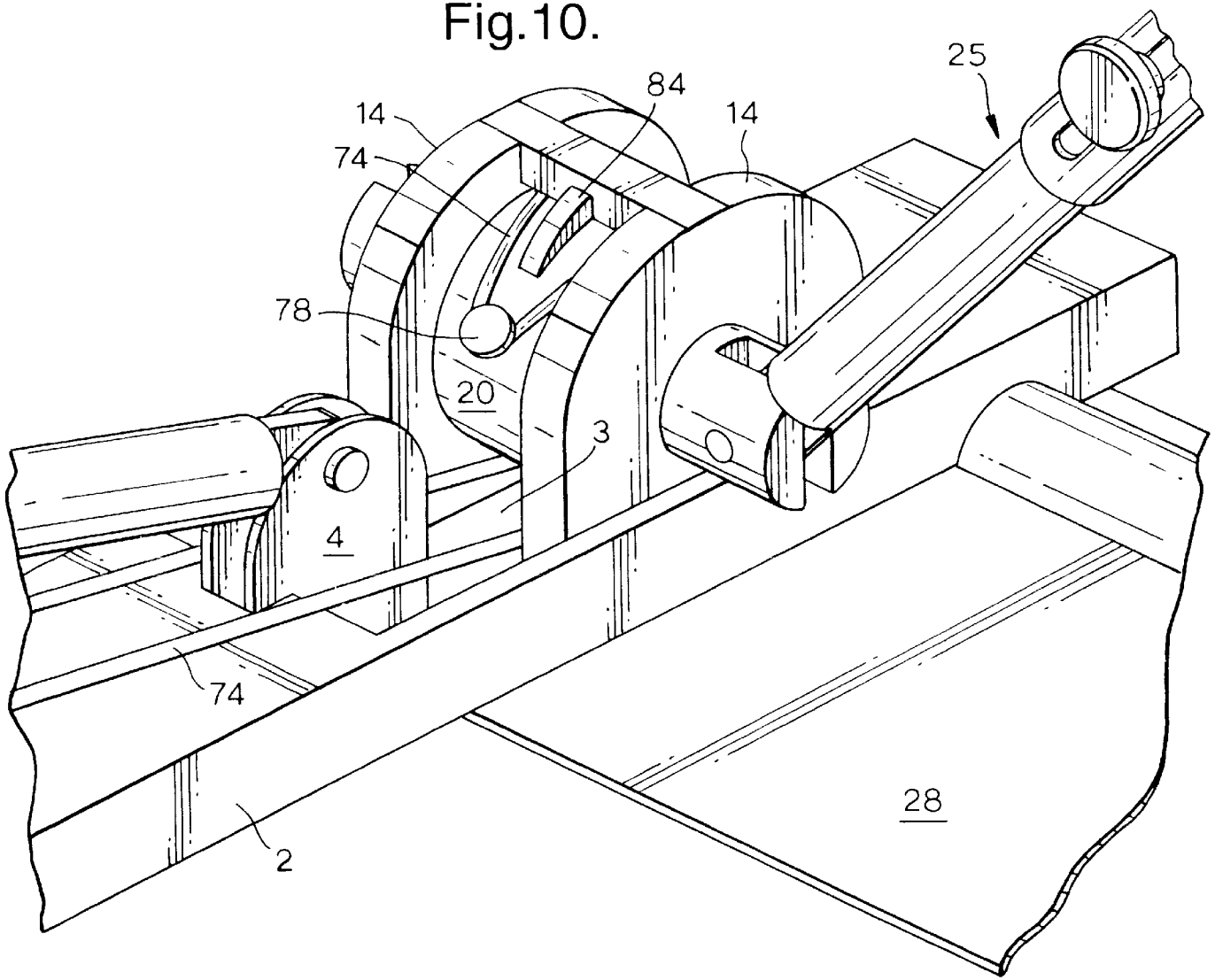
Figure 11:
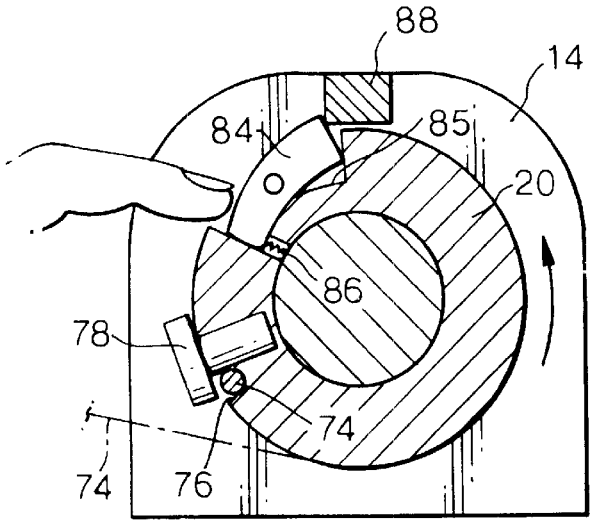

Head unit 20 serves as a cable drum around which is slung a doubled-up cable 74, as seen to best effect in FIG. 10. Cable 74 is partly led inside a groove 76 and, at its midpoint, is retained by a headed pin 78 (FIGS. 10 and 11). The two ends of cable 74 are provided with terminals 80, which are fixedly attached to tabs 82 that are either integral parts of pusher arm 44, or fixedly connected to it.

Clearly, when handle 25 is turned in the counter-clockwise direction (FIG. 7), cable 74 is wound onto head unit 20, pulling pusher arm 44 towards the right, thereby pushing plunger 12 into cylinder 10 against the resisting force of spring 9.

Figure 9:
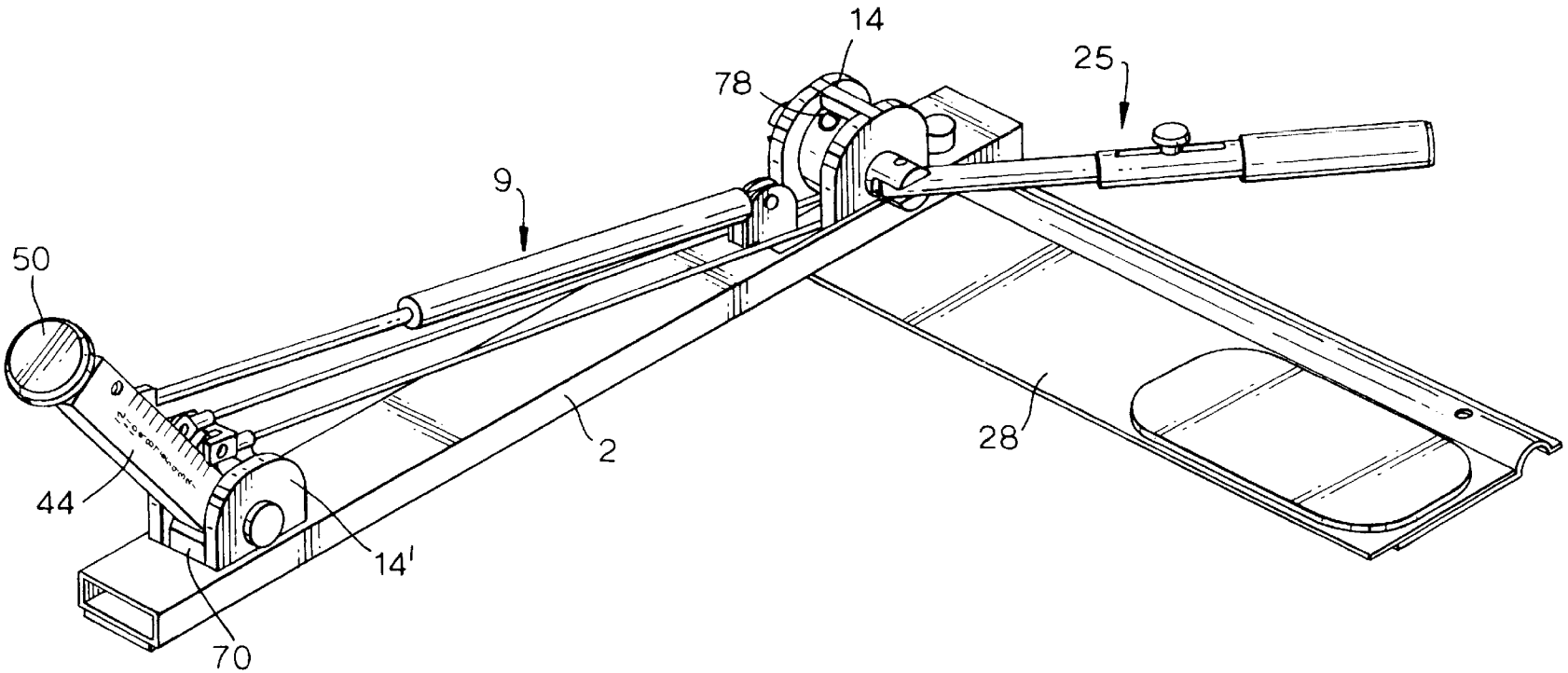

Head unit 20 fulfills two functions: it serves as a cable drum, as already mentioned, and it defines the starting position, in which handle 25 is located in a vertical plane. This is effected by a pawl 84, pivotably mounted in a recess 85 in head unit 20 (FIG. 11). After handle 25 is moved from the position shown in FIG. 9 to a position slightly beyond the vertical position, the pawl is pushed down by the user's finger against the restoring force of a spring 86, as shown in FIG. 11. When the user's pressure on handle 25 is now reduced, with the user's finger still in position, pawl 84 will come to abut against a bridge element 88, thus serving as a positive stop. Because of friction, pawl 84 stays in position even after the user's finger is withdrawn (FIG. 12) and the "contest" can now begin. However, as soon as the user has tilted handle 25 to the slightest degree in the counter-clockwise direction, pawl 84 snaps back into recess 85 and ceases to function as a stop, thereby giving the device a chance to "defeat" the user, as spring 9 will now be able to rotate head unit 20 in the clockwise direction (FIG. 13), no longer being stopped by pawl 84, and thus urging the user's arm down towards the table.

As in the first embodiment, the mechanical advantage offered by the device is set by means of thumbscrew 50.

Blade 70 (FIG. 9) now serves to define the horizontal position of handle 25.

The embodiment of FIG. 7 can also be used for a fair competition between unequal partners, e.g., an adult and a child, with the adult operating handle 25 against the opposing force of spring 9. The junior partner sits on the opposite side of the table and grips a second handle 25 optionally provided and attached to the free end of shaft 18 (FIG. 1). With such an arrangement, the adult has to battle against the force of the junior plus the force of spring 9.

Although, in principle, it is possible to use a helical compression spring as a counter-force, such use would entail several disadvantages, the most serious of which resides in the fact that, to provide a full stroke length with the pusher arm at about ¾ of its full length, a spring arrangement based on a helical spring would have to be about twice the length of the gas spring arrangement. Not less important is the fact that the steep characteristic of a helical spring would provide the user with a sensory feedback quite different from that produced by a human opponent, while the rather flat characteristic of a gas spring provides a counter-force that, over the entire stroke, does not vary by more than about 30% and is thus much closer to the real-life situation.

It is possible to mount gas springs having different gas pressures for different ranges of forces involved.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A hand-wrestling training device, comprising:

an elongated main base having a first end and a second end, the first end having a mounting means;

a spring means having a first end and a second end, said spring means hingedly articulated at the spring means first end to said mounting means;

at least one mounting plate fixedly attached to said main base near the second end of said base;

a head unit pivotably mounted in said mounting plate;

a pusher arm having a first end and a second end, said pusher arm fixedly attached at the pusher arm first end to said head unit and provided with a plate element at the pusher arm second end;

a body movable in translation along said pusher arm, the second end of said spring means being articulated to said body;

adjustments means for altering the mechanical advantage afforded to the user by moving said body along said pusher arm, thereby altering the effective length of said pusher arm; and a gripping handle hingedly attached to a portion of said head unit, said gripping handle, when turned downward, causing said pusher arm to be applied against the opposing force of said spring means.

2. The device as claimed in claim 1, said main base having two parallel mounting plates located at a distance from one another and provided with co-axial bores.

3. The device as claimed in claim 1, wherein said head unit includes shaft means having two ends, said shaft means being fixedly connected thereto and pivotably fitting the bores in said mounting plates.

4. The device as claimed in claim 3, wherein both ends of said shaft means project from their respective mounting plates.

5. The device as claimed in claim 1, wherein the main base has two longitudinal sides and the device further comprises a secondary base attachable to said main base for selectively projecting from one or the other longitudinal side of said main base.

6. The device as claimed in claim 1, wherein said adjustment means comprises a thumbscrew provided with a threaded shaft passing through said plate element and having one degree of freedom in rotation about its axis.

7. The device as claimed in claim 6, wherein said body is provided with an internal thread engaging the threaded shaft of said thumbscrew.

8. The device as claimed in claim 1, wherein said spring means is a gas spring comprising a cylinder and a plunger.

9. The device as claimed in claim 1, wherein said gripping handle has one degree of freedom in rotation relative to said head unit in a plane containing the axis of pivoting of said head unit.

10. A hand-wrestling training device, comprising:

an elongated main base having two ends;

a first pair of mounting plates attached to said main base near one of the ends thereof, and a second pair of mounting plates attached to said main base near the other one of the ends thereof;

a first and a second head unit pivotably mounted in said first and second pairs of mounting plates respectively;

mounting means carried by said main base, to which mounting means is articulated one end of a spring means having two ends;

a pusher arm fixedly attached to the first of said head units;

a body movable in translation along said pusher arm, to which body is articulated the second end of said spring means, and cable means having a first effective end a second effective end, the first effective end of which is anchored to said second head unit, the second effective end of which is articulated to said pusher arm.

11. The device as claimed in claim 10, further comprising a pawl pivotably mounted in a recess in said second head unit and having two limit positions, in the first one of which it is flush with the surface of said second head unit, and in the second one of which it can be swung out from said first limit position against the restoring force of a spring.

12. The device as claimed in claim 10, further comprising a beam-like bridge element attached to said second pair of mounting plates and located above said second head unit, said bridge element serving as abutment for said pawl when said pawl is in the second of its limit positions.

* * * * *